United States Patent [19]

Perry et al.

[11] 4,414,441

[45] Nov. 8, 1983

[54] HYDROCARBON RESPONSIVE SWITCH

[75] Inventors: Ralph A. Perry, Indianapolis; Raymond J. Andrejasich, Carmel, both of Ind.

[73] Assignee: Emhart Industries, Inc., Indianapolis, Ind.

[21] Appl. No.: 364,641

[22] Filed: Apr. 2, 1982

[51] Int. Cl.[3] ..... H01H 35/34

[52] U.S. Cl. ..... 200/61.04; 200/242

[58] Field of Search ..... 200/61.04, 61.03, 242; 340/632, 627; 428/461

[56] References Cited

U.S. PATENT DOCUMENTS

| | | | |
|---|---|---|---|
| 2,432,367 | 12/1947 | Andresen | 200/61.04 |
| 3,073,162 | 1/1963 | Ulanet | 200/61.04 X |
| 3,427,414 | 2/1969 | Sheldahl | 200/61.04 |
| 3,470,340 | 9/1969 | Hakka | 200/61.04 |
| 4,105,882 | 8/1978 | Ubling et al. | 200/242 |

FOREIGN PATENT DOCUMENTS

| | | | |
|---|---|---|---|
| 22303 | of 1911 | United Kingdom | 200/61.03 |

*Primary Examiner*—Elliot A. Goldberg
*Assistant Examiner*—Morris Ginsburg
*Attorney, Agent, or Firm*—Robert F. Meyer; David W. Gomes

[57] ABSTRACT

A hydrocarbon responsive switch provides an elongated flexible member which is impervious to hydrocarbon substances, a hydrocarbon absorber bonded to the elongated flexible member for absorbing hydrocarbon substances in contact therewith and for swelling from the absorbing for causing the flexible member to bend, a mounting for one end of the elongated member, a first electrical contact located at the other end of the elongated member, and a second electrical contact for contacting the first contact upon bending of the elongated flexible member and thereby making electrical connection in response to the absorption of hydrocarbon substances by the absorber.

4 Claims, 1 Drawing Figure

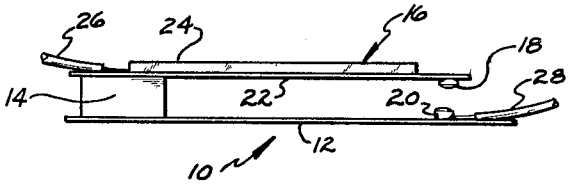
26
24
16
18
28
14
22
20
12
10

HYDROCARBON RESPONSIVE SWITCH

BACKGROUND OF THE INVENTION

1. Field of the Invention

The present invention generally relates to hydrocarbon detectors and, in particular, to those detectors used for determining the presence of liquid hydrocarbon substances.

2. Statement of the Prior Art

Instruments for detecting the presence of oil and related hydrocarbon substances have been in use for many years. One variety of such instruments which has lately become increasingly popular is one which includes those instruments used for distinguishing between water and hydrocarbon liquids. Such instruments are usually used to detect either the contamination of water by hydrocarbon substances or the contamination of hydrocarbon substances with water. The wide scale presence of hydrocarbon substances such as oil and gasoline in our environment and their wide spread use in society necessitates that such instruments be readily available and widely used in order to insure a healthy environment and to avoid long term, large scale pollution of our environment. For these reasons, such sensors have been extensively developed and are generally based on a wide variety of operating principles or characteristics of the liquids being detected. These operating principles generally include electrical conductivity, thermal conductivity, liquid density, light transmission, and even the solubility of various materials in hydrocarbon environments. Such systems are exemplified by a number of United Sates patents describing a wide variety of instruments. For example, U.S. Pat. Nos. 3,800,219 and 4,131,773 describe instruments which are based upon the operating principle that the electrical conductivity of water is greater than the electrical conductivity of oil and related hydrocarbon substances. While the '219 patent describes a complicated mechanism for taking a sample of liquid from the top surface of a body of water, the '773 patent describes a sensor having a pair of electrodes submerged in water and another pair of electrodes enclosed in an oleophatic material floating on the surface of the water. The characteristic that the thermal conductivity of water is greater than that of oil and related hydrocarbon substances is used as an operating principle in U.S. Pat. Nos. 4,221,125, 4,135,186, and 4,116,045. These instruments generally include the application of a constant predetermined amount of heat to a thermal sensor and one or more measurements of the temperature of that sensor before and/or after that application of heat. The physical property of liquid density is used as the operating principle in instruments described by U.S. Pat. Nos. 3,918,034 and 3,946,625. These patents both use the floatation level of a float to trip a magnetic reed switch to thereby signal the presence of the lighter density oil and related hydrocarbon substances. The principle of light transmission is used by an instrument described in Japanese Pat. No. 52-17891. Lastly, the solubility of various substances in oil and related hydrocarbon substances is used as the operating principle in a sensor described by U.S. Pat. No. 3,720,797. In this sensor, a spring loaded switch is encased and held open by a material which is soluble in gasoline and similar hydrocarbon liquids in water. The presence of such hydrocarbons causes the encasing material to dissolve and allows the switch to close and thus signal the presence of such substances. These devices, of course, are not the only ones which make use of their respective operating principles but have been chosen for description here as being exemplary of the various approaches taken. This wide variety of instruments and the development work which has gone into them is good evidence of the strong need for such instruments. Unfortunately, the instruments detailed above are rather complex in their manufacture and/or use. Wherever there is such a large need for any sort of a sensing element, such an element which includes the qualities of simplicity and inexpensiveness will always be welcomed.

SUMMARY OF THE INVENTION

Accordingly, a hydrocarbon responsive switch comprises an elongated flexible member which is impervious to hydrocarbon substances, means bonded to the elongated flexible member for absorbing hydrocarbon substances in contact therewith and for swelling from this absorbing for causing the flexible member to bend, means for mounting one end of the elongated member, first electrical contact means located at the other end of the elongated member, and second electrical contact means for contacting the first contact means upon bending of the elongated flexible member and thereby making electrical connection in response to the absorption of hydrocarbon substances by the means for absorbing. In one embodiment, the elongated member is made from thin stainless steel and the means for absorbing includes ethylenepropylene.

DESCRIPTION OF THE DRAWING

The FIGURE is a side view of a conceptual embodiment of the present invention.

The FIGURE shows a switch 10 generally including a base 12, a mounting means 14, a flexible member 16 and a pair of contacts 18 and 20. The base 12 may consist of any suitable material and is generally rigid. The mounting means 14 is used in the present embodiment to separate the flexible member 16 from the base 12. Also in the present embodiment, mounting means 14 consists of insulating material, the purpose for which is described below.

Flexible member 16 includes a flexible elongated member 22 which member is impervious to liquids. As presently conceived, member 22 is constructed from stainless steel having a thickness of approximately 0.003 inches. By being made sufficiently thin, the stainless steel becomes flexible. The flexible member 16 further includes a hudrocarbon absorbing means 24 which is bonded to the elongated member 22 along a substantial amount of the elongated length thereof. Absorbing means 24 may be made from a piece of ethylene propylene having a thickness of approximately 0.062 inches. The ethylene propylene is non-absorbing to water but absorbing for hydrocarbon liquids. Thus, the switch 10 may be successfully located on a float for hydrocarbon detection at the surface of water.

Absorbing means 24 may be bonded to elongated member 22 by any suitable means. One such means is an adhesive producing by Dow Corning and identified as RTV-734.

As shown, the elongated member 22 is mounted at one end thereof to the mounting means 14. Further, electrical contact 18 is mounted in an electrically conductive manner at the other end of member 22. As shown, elongated member 22 acts as an electrical conductor for switch contact 18. This allows a wire 26 to be attached to the elongated member 22 near the mounted end thereof instead of to the electrical contact 18. This prevents any interference with the movement of the free end of member 22 by any wires which would otherwise be attached to the contact 18.

The electrical contact 20 is mounted to base 12 at a position to make contact with the contact 18 upon the bending of flexible member 16. In general, this means that contact 20 is mounted along the arc followed by contact 18 during the bending of member 22. As a refinement, the contact 20 does not lie squarely on the arc followed by contact 18 but instead is slightly offset from the arc in order to cause the contact 18 to wipe thereagainst to abrasively achieve physical contact. This wiping or abrasion acts to form a good electrical connection between the contacts 18 and 20 by reducing or removing residue from oil or other insulating hydrocarbons located on the surfaces of the contacts 18 and 20.

Wire 28 is connected to the contact 20 to complete the electrical circuit of the switch 10. Of course, any suitable further connections may be made with the wires 26 and 28 to adapt the switch 10 for any practical use.

Thusly constructed, the switch of the present invention provides a simple and inexpensive switch for detecting the presence of liquid hydrocarbons. The switch 10 may be wired into any suitable detection or alarm circuit. In the case of some hydrocarbons such as gasoline and alcohol, the absorber 24 may be air dried and reused. In other cases the flexible member 16 may be affixed to mounting means 14 and wire 26 by removable means, such as a screw, which allows replacement of the member 16 after the absorbtion of hydrocarbons by the absorbing means 24.

The description of the above embodiment is intended to be taken in an illustrative and not a limiting sense. Various modifications and changes may be made to the above embodiment by persons skilled in the art without departing from the scope of the present invention as described in the appended claims.

What is claimed is:

1. A hydrocarbon responsive switch, comprising:

an elongated flexible member which is impervious to hydrocarbon substances;

means including ethylene propylene, bonded to said elongated flexible member for absorbing hydrocarbon substances and not absorbing water in contact therewith and for swelling from said absorbing of hydrocarbon substances for causing said contact member to bend;

means for mounting one end of said elongated member;

first electrical contact means located at the other end of said elongated member; and second electrical contact means for contacting said first contact means upon bending of said elongated flexible member and thereby making electrical connection in response to the absorption of hydrocarbon substances by said means for absorbing.

2. The switch of claim 1, wherein said member is made from stainless steel being sufficiently thin to allow said member to bend.

3. The switch of claim 2, wherein said first contact means is mounted in electrical contact with said stainless steel and further wherein said means for mounting said one end of said member includes insulating means for allowing said member to be used to make electrical contact with said first contact means for preventing interference with the movement of said elongated member by any wires connected to said first contact means.

4. The switch of claim 1, further comprising second means for mounting said second electrical contact means for causing said first and second contact means to abrasively contact each other upon making said electrical connection.

* * * * *